US005148564A

United States Patent [19]

Reder

[11] Patent Number: 5,148,564

[45] Date of Patent: Sep. 22, 1992

[54] MINIATURE PORTABLE SUPPORT CONSTRUCTION

[76] Inventor: Larry M. Reder, 3152 Casino Dr., Thousand Oaks, Calif. 91362

[21] Appl. No.: 810,476

[22] Filed: Dec. 19, 1991

[51] Int. Cl.[5] ..... A47C 20/02

[52] U.S. Cl. ..... 5/636; 5/490

[58] Field of Search ..... 5/431, 434, 436, 437, 5/441, 442, 490, 491

[56] References Cited

U.S. PATENT DOCUMENTS

| | | | |
|---|---|---|---|
| D. 126,825 | 9/1941 | Kolisch | D6/601 |
| 414,748 | 11/1889 | Bentley | 5/442 |
| 1,212,515 | 1/1917 | Leavitt | 5/436 |
| 1,754,937 | 4/1930 | Comstock | 5/434 |
| 2,522,120 | 9/1950 | Kaskey et al. | 5/436 X |
| 4,007,503 | 2/1977 | Watkin | 5/490 |
| 4,679,262 | 7/1987 | Davis et al. | 5/434 |

*Primary Examiner*—Michael F. Trettel

[57] ABSTRACT

A miniature portable support pillow construction having a generally smooth outer contoured similar to a barbell, i.e., generally cylindrical and enlarged at each end. The pillow is only about four to five inches in diameter and about nine to ten inches long for ease of transport. The illustrated pillow has an inner body made of a soft resilient material such as (fiberfill) material formed in the barbell shape. The pillow further has a removal outer cover that is made of flexible material and surrounds and conforms to the shape of the body. The cover is made from a plurality of elongated contoured strips of flexible material that are stitched to one another to form the cover. Two of the strips have overlapping unstitched band portions that form an entrance/exit for the cover. A fastener such as interlocking "Velcro" strips may be secured to the band portions to releasably lock the entrance closed.

6 Claims, 2 Drawing Sheets

Fig. 1
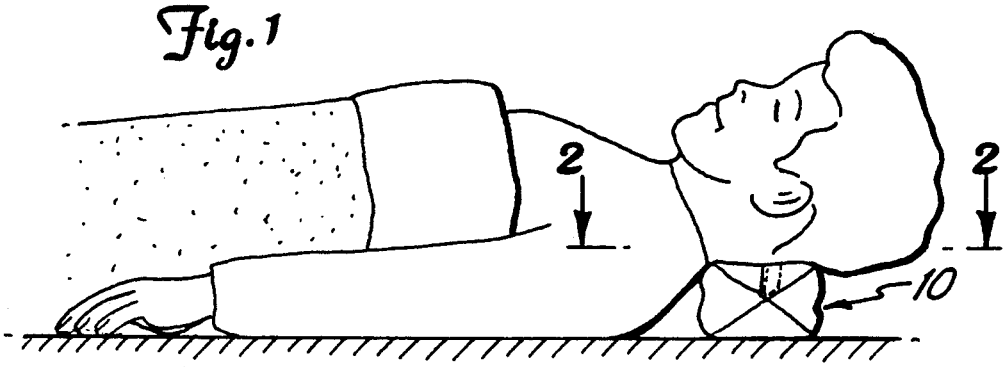
Fig. 2
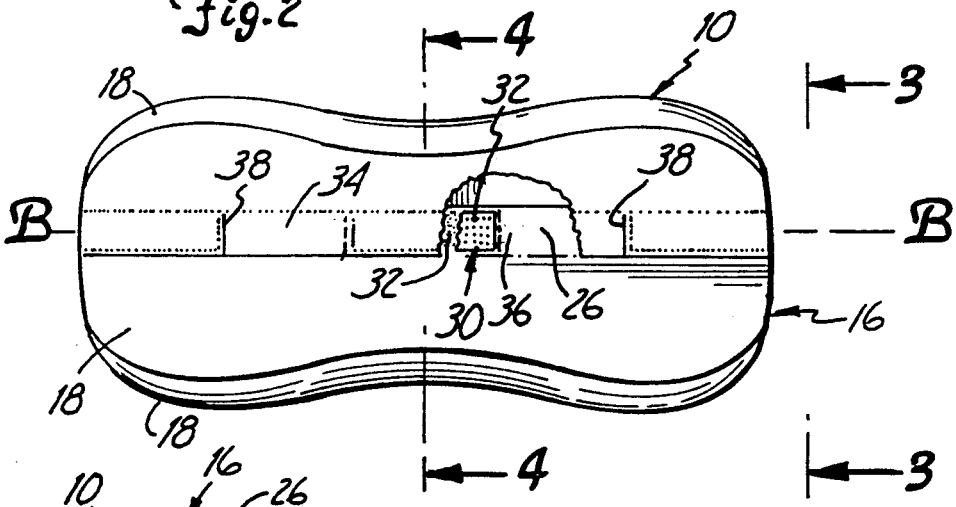
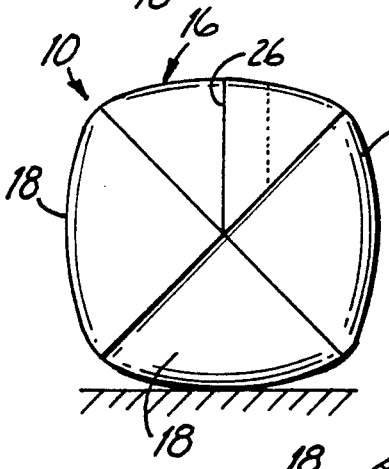
Fig. 3
Fig. 4
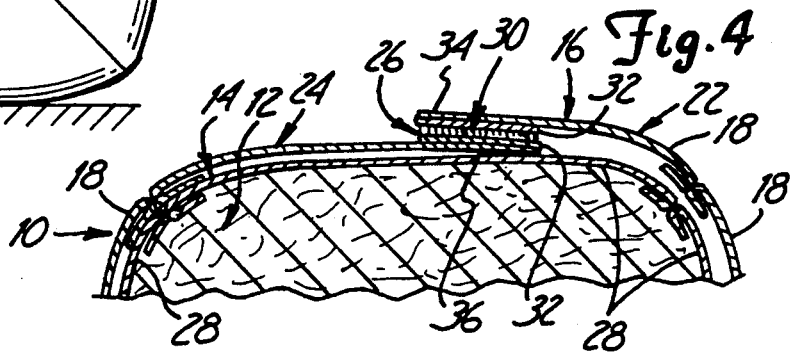

MINIATURE PORTABLE SUPPORT CONSTRUCTION

BACKGROUND OF THE INVENTION

Comfort and/or support pillows come in a variety of shapes and forms, for general as well as many specialized applications.

The present invention contemplates a specialized miniature portable support pillow especially designed for the travel use. This pillow can be easily and conveniently carried onto an airplane, a train, a bus or the like. The pillow is particularly useful for being positioned behind the seated rider's neck and against the seat, being held in position by the backward weight of the person.

An important feature of the invention is its size or dimensions in a travel type pillow of the illustrated construction. The illustrated pillow is about four to five inches in maximum diameter and about nine to ten inches long. This allows the pillow to be easily and conveniently carried in a purse or a piece of carry-on luggage or even a briefcase or a large pocket. The resilient nature of the pillow contributes to this ease of transport by allowing the pillow to be compressed into a smaller or irregular space. Even a moderately larger size pillow is much less convenient to transport, requiring a separate container or the pillow being carried separately by hand.

SUMMARY OF DISCLOSURE

The illustrated miniature portable travel pillow contemplates an improved simple and economical yet highly effective pillow for such purpose. The illustrated pillow is generally barbell-shaped, being elongated and generally cylindrical, while being enlarged and rounded off at opposite ends. The pillow is no more than about four inches in diameter nor about nine inches long. This provides ease and convenience in transporting it onto an airplane, bus, car or like. The soft resilient shaped body is enclosed within a conforming outer casing that is removable for washing, cleaning, repair and the like. The illustrated cover is made up of a series of elongated contoured strips that are sewn together along their longitudinal edges to form the cover. There is a longitudinal opening defining an entrance between a first and second of the strips through which the body may be inserted and removed from the cover. The illustrated strips share a generally common or like outline which is symmetrical about a longitudinal axis. The edges meet one another at the axis at opposite ends of the strip. The edges then curve outwardly from either end to define enlarged end portions of the strip and then converge back toward the axis to define a narrowed central portion. The two strips which define the entrance opening each have the same curved longitudinal edge along one side, but are each modified so as to have a straight band portion along the opposite side to provide the opening entrance. When the strips are assembled to form the cover, the straight-line band portions of the entrance strips overly one another. Fastening means such as hook and loop fastener strips sold under the trademark "Velcro" may be secured to band portions to provide releasable locking of the casing.

IN THE DRAWINGS

FIG. 1 is an illustration of a person sleeping on their back with a pillow which is a presently preferred embodiment of the invention positioned under their neck for support and comfort.

FIG. 2 is a top plan view of the pillow construction of FIG. 1.

FIG. 3 is an elevational view taken generally along line 3—3 of FIG. 2.

FIG. 4 is an enlarged partial cross-sectional transverse view taken generally along line 4—4 of FIG. 2.

DETAILED DESCRIPTION OF THE DRAWINGS

FIG. 1 illustrates one use of the miniature portable support pillow construction of the present invention. A pillow 10 which embodies the presently preferred form of the invention is shown disposed under the neck of a sleeping or resting person.

Figure 5:
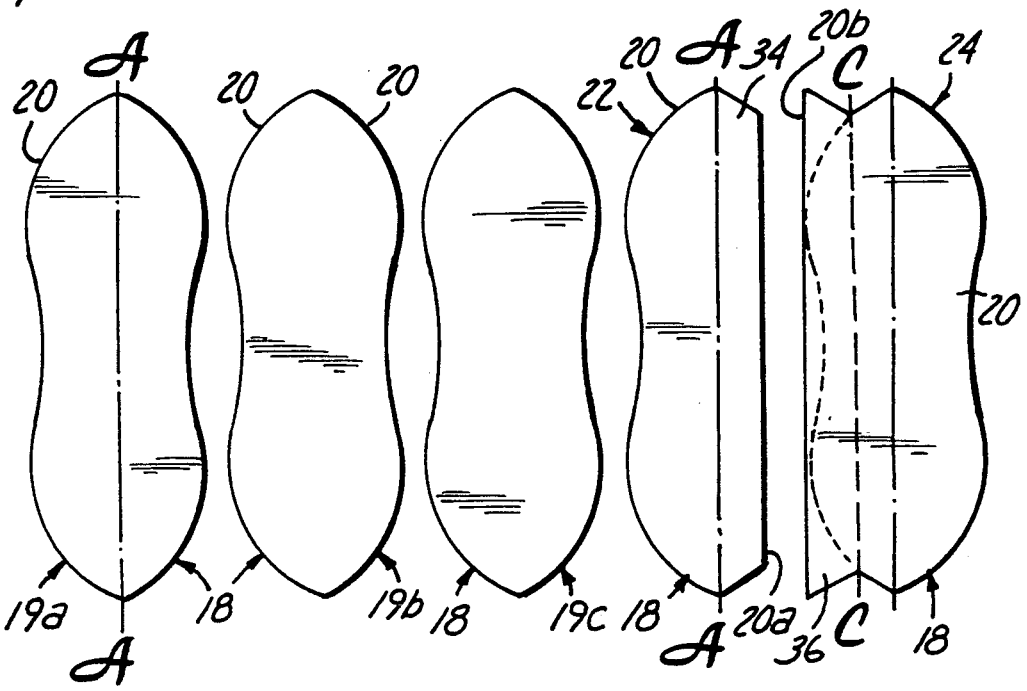
FIG. 5 is a plan view of the five strips which are assembled to form the outer removable cover for the pillow of FIG. 1–4.

In general, the illustrated support pillow construction 10 comprises an inner body 12 (see FIG. 4) of soft resilient material formed in the hour-glass or barbell shape shown in FIG. 2. There is an inner cover 14 of flexible material which surrounds and conforms to the shape of the body. There is a removable outer cover 16 of flexible material which also conforms to the shape of the inner body and which surrounds the body and inner cover 14. As shown in FIG. 5, the outer cover 16 is comprised of five elongated strips 18 of flexible material which are stitched together along their contoured longitudinal edges 20 to form the cover. A first entrance strip 22 and a second entrance strip 24 are specially shaped or contoured to provide an entrance/exit 26 for the outer cover 16.

Figure 6:
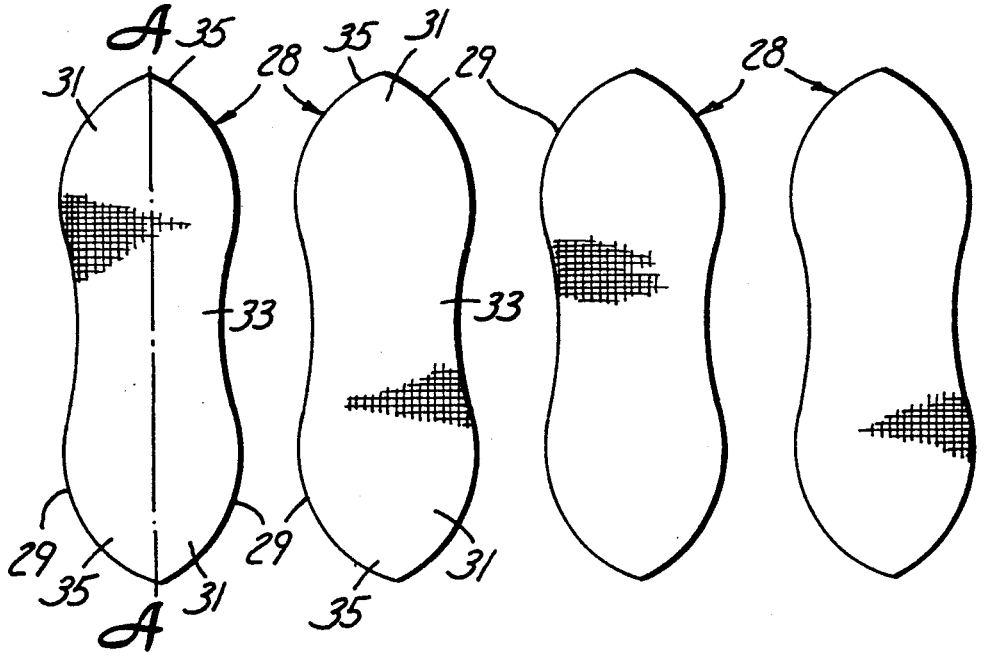
FIG. 6 is a plan view of the four strips which are assembled to form the inner cover for the pillow construction of FIGS. 1–4.

FIG. 6 illustrates four similarly shaped elongated strips 28 which are sewn together to form the inner cover 14. As shown in FIGS. 2 and 4, a fastening means 30 such as releasably interlocking "Velcro" strips 32 may be provided at the entrance 26 for releasably locking the entrance closed.

More particularly, the inner illustrated body 12 may be made of any suitable soft resilient compliant material such as (fiberfill) material, soft foam plastic, feathers, down or other man-made materials such as those used in sleeping bags and/or cushions.

The inner cover 14 of the illustrated pillow is formed by the six elongated strips 28 as shown in FIG. 6. The strips 28 each have an identical shape or outline. Each strip 28 has an elongated central axis or cord A—A. Each of the longitudinal edges 29 of each strip 28 are curved and join with one another at opposite ends of the strip at the central axis A—A. From each end, the longitudinal edges 29 curve outwardly to form an enlarged end portion 31. The longitudinal edges 29 then converge somewhat inwardly to form a narrower central portion 33. The strips 28 are sewn together along their longitudinal edges 29 to form the generally cylindrical but centrally narrowed shape. The pointed ends 35 of the strips 28 are sewn together to form generally flat transversely extending end walls of the cover 14. In particular, at each end of the inner cover 14, the pointed ends 35 of the strips 28 turn inwardly and meet at the central axis B—B of the cover.

The outer cover 16 is comprised of the five strips 18 of flexible material shown in FIG. 5. These 18 strips are sewn together to form the barbell pillow shape described above. Three of the strips 19*a*, 19*b*, 19*c* are contoured essentially like the strips 28 that form the inner cover. The other two or entrance/exit forming strips 22,24 are modified to provide the entrance/exit 26. The first of the entrance strips 22 in effect has one side cutoff to provide a straight-line outer longitudinal edge 20*a*. The second entrance strip 24 has additional material and also has a straight-line longitudinal edge 20*b* at one side. For purposes of description only, the drawing in FIG. 5 of the second entrance strip 24 shows in broken line where the curved outer longitudinal edge of that strip would extend if the strip had not been modified. It can be seen that the straight-line longitudinal edge 20*b* of that strip 24 runs generally tangential to the outer-most portions of that imaginary curve. The straight-line edge 20*b* extends the full length of the strip 24 (which is the full length of the central axis A—A of the strips). It can be seen that the first entrance strip 22 has an entrance band portion 34 that runs longitudinally between the straight outer edge 20*a* and the central axis A—A of the strip. The second entrance strip 24 also has an entrance band portion 36 of the same size and shape as the band portion 34 of the first strip 22. The band portion 36 of the second strip 24 extends from the straight outer edge 20*b* of the second strip inwardly therefrom to an imaginary straight line C—C which is approximately half way to the central axis A—A of the second strip. It will be noted that these band portions 34, 36 mirror one another so that when one is placed over the other, they essentially overlap.

As shown in FIGS. 2-4, when the outer cover 16 is assembled and the strips 18 are sewn to one another, the entrance bands 34, 36 overlap to form the entrance/exit 26 to the outer cover.

Because of the flexible nature of the outer cover 16 and the resilient pliable nature of the inner body 12, the pillow construction may be manipulated to remove the inner body (and its flexible inner cover 14) from the outer cover through the entrance/exit 26. Similarly, the body may be manipulated to put it back inside the outer cover.

As shown in FIG. 2, the entrance bands portions 34, 36 may be stitched to one another at desired locations 38 to define the length of the entrance/exit 26. Further, as shown best in FIGS. 2 and 4, fastening means 30 may be provided for releasably locking the band portions to one another to releasably maintain the entrance/exit in the closed condition. The illustrated pillow construction 10 is provided with hook and loop fastener strips 32, sold under the trademark "Velcro" one secured to the underside of the overlying band portion 34 and the other secured to the topside of the underlying band portion 36. As is well known in the art, the hook and loop fastener strips releasably interlock with one another. The easy removability of the outer cover 16 from the pillow body is particularly convenient for purposes of washing, cleaning, repairing or even replacing the outer cover or the body and inner cover.

Various modifications and changes may be made in the illustrated structure without departing from the spirit and scope of the present invention as set forth in the following claims.

I claim:

1. A miniature portable travel pillow construction generally in the shape of a generally contoured barbell that is elongated with a central axis, a pair of opposed enlarged ends and a narrowed center, said pillow construction comprising:

(1) a body of a soft resilient material in the shape of the pillow construction;

(2) a removable outer cover of flexible material surrounding and generally conforming to the shape of the body;

said cover comprised of a plurality of elongated strips each having a central longitudinal axis and longitudinal edges stitched to the adjacent longitudinal edges of the adjacent strips, a first of said strips having first closure band portion along one longitudinal edge, a second of said strips having a second closure band portion along one longitudinal edge, said band portions generally overlying one another when the outer cover is assembled to form a longitudinal opening that defines an entrance/exit for the cover, the longitudinal edges of the remainder of said strips and the other longitudinal edges of the first and second closure strips each having a shape that is defined by a generally like curve, each of said curves meeting the central axis of the strip at the opposite ends of the strips, then curving first transversely outwardly from each end, and then curving back transversely inwardly;

the pillow construction being no longer than about ten inches and no wider than about five inches at its maximum diameter.

2. The pillow construction of claim 1 further comprising an inner cover surrounding and generally conforming to the shape of the body, said inner cover being made from a plurality of elongated contoured strips of flexible material that are stitched together along their longitudinal edges, each of said strips having a central longitudinal axis, and a like curve along each longitudinal edge, said curved longitudinal edges of each strip meeting each other at each end of the strip at the central longitudinal axis, said longitudinal edges then curving outwardly from the longitudinal center axis to define an enlarged portion at each end of the strip, the longitudinal edges then converging inwardly toward one another to define a narrower central portion of the strip intermediate the end portions.

3. The pillow construction of claim 1 further comprising fastener means on the first and second band portions for releasably holding the closure bands to one another to releasably lock the entrance/exit in the closed position.

4. The pillow construction of claim 3 wherein said fastener means comprises a pair of interlocking hook and loop fastener strips secured to said band portions.

5. The pillow construction claim wherein said diameter is about four and one-half inches and the length is about nine and one-half inches.

6. A miniature portable travel pillow construction generally in the shape of a contoured barbell that is elongated with a central axis, a pair of opposed enlarged ends and a narrowed center, said pillow construction being generally symmetrical about said central axis and comprising:

(1) a body of a soft resilient material in the shape of the pillow construction;

(2) an inner cover of flexible material surrounding and generally conforming to the shape of said body;

(3) a removable outer cover surrounding the body and the inner cover and generally conforming to the shape of the body;

said covers each being comprised of a plurality of elongated strips each having a central longitudinal axis and longitudinal edges stitched to the adjacent longitudinal edges of the adjacent strips, a first of said strips for the removable outer cover having first generally linear closure band portion along one longitudinal edge, a second of said strips for the outer cover having a second generally linear closure band portion along one longitudinal edge, said band portions generally overlying one another when the outer cover is assembled to form a longitudinal opening that defines an entrance/exit for the cover, the longitudinal edges of the remainder of said strips of both covers and the other longitudinal edges of said first and second closure strips each having a shape that is defined by a generally like curve, each of said curves meeting the central axis of the strip at the opposite ends of the strips, then curving first transversely outwardly from each end, and then curving back transversely inwardly;

(4) fastening means on the closing band portions in the form of releasably interlocking hook and loop fastener strips for releasably holding the entrance/exit opening closed;

the pillow construction being about nine and one-half inches long and about four and one-half inches across at its maximum diameter.

* * * * *